US009435580B2

(12) United States Patent
Dubina et al.

(10) Patent No.: US 9,435,580 B2
(45) Date of Patent: Sep. 6, 2016

(54) DRAWER ASSEMBLY

(71) Applicant: Electrolux Home Products, Inc., Charlotte, NC (US)

(72) Inventors: Paul Dubina, Anderson, SC (US); Adam Ellis, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 0 days.

(21) Appl. No.: 14/333,805

(22) Filed: Jul. 17, 2014

(65) Prior Publication Data

US 2016/0018157 A1 Jan. 21, 2016

(51) Int. Cl.

| | |
|---|---|
| ***F25D 25/02*** | (2006.01) |
| ***F25D 23/06*** | (2006.01) |
| ***F25D 23/02*** | (2006.01) |
| ***A47B 77/18*** | (2006.01) |
| *A47B 88/04* | (2006.01) |

(52) U.S. Cl.

CPC ..... *F25D 25/025* (2013.01); *F25D 23/067* (2013.01); *A47B 77/18* (2013.01); *A47B 2088/0429* (2013.01); *A47B 2210/175* (2013.01); *F25D 23/021* (2013.01)

(58) Field of Classification Search

CPC ..... A47B 88/0003; A47B 88/04; A47B 88/0407; A47B 88/0418; A47B 88/0422; A47B 88/0425; A47B 88/0429; A47B 2210/09; A47B 2210/17; A47B 2210/175; F25D 25/00; F25D 25/005; F25D 25/022; F25D 25/024; F25D 25/025

See application file for complete search history.

(56) References Cited

U.S. PATENT DOCUMENTS

| | | | | |
|---|---|---|---|---|
| 2,973,998 | A * | 3/1961 | Rackliffe | 312/332 |
| 4,244,546 | A * | 1/1981 | Mertes et al. | 248/258 |
| 4,579,402 | A * | 4/1986 | Wenzlick et al. | 312/330.1 |
| 5,215,362 | A * | 6/1993 | Zoellner | 312/246 |
| 5,306,080 | A * | 4/1994 | Lautenschlager | A47B 88/044 312/334.5 |
| 6,637,848 | B2 * | 10/2003 | Lin | 312/334.23 |
| 6,695,420 | B2 * | 2/2004 | Ackerman | 312/348.4 |
| 7,281,775 | B2 * | 10/2007 | Yang | 312/348.1 |
| 7,810,890 | B2 | 10/2010 | Klein | |
| 7,883,163 | B2 * | 2/2011 | Dorner et al. | 312/404 |
| 8,056,996 | B2 | 11/2011 | Koloff | |
| 8,141,966 | B2 * | 3/2012 | Placke et al. | 312/334.7 |
| 8,356,865 | B2 | 1/2013 | Laible | |
| 8,382,218 | B2 | 2/2013 | Placke | |
| 8,511,767 | B2 | 8/2013 | Haidar | |

(Continued)

FOREIGN PATENT DOCUMENTS

| | | | | |
|---|---|---|---|---|
| EP | 37034 | A1 * | 10/1981 | A47B 88/04 |
| EP | 2325589 | A2 * | 5/2011 | F25D 25/02 |

(Continued)

*Primary Examiner* — Andrew Roersma
(74) *Attorney, Agent, or Firm* — Pearne & Gordon LLP

(57) ABSTRACT

A drawer assembly is provided for a refrigeration appliance. The drawer assembly comprises a unitary storage bin configured to move relative to the cooled compartment. The storage bin is defined by a front wall, a rear wall and opposed sidewalls that are arranged substantially parallel to the first and second interior walls of the cooled compartment. An uppermost portion of each of the opposed sidewalls comprises a projecting edge. The rear wall comprises a reinforced edge that inhibits deflection. A pair of linear motion elements is installed to enable movement of the storage bin in and out of the cooled compartment. A pair of support brackets couples the pair of linear motion elements.

20 Claims, 8 Drawing Sheets

(56) References Cited

U.S. PATENT DOCUMENTS

| | | | | |
|---|---|---|---|---|
| 2008/0203875 | A1 | 8/2008 | Lim et al. | |
| 2009/0066207 | A1* | 3/2009 | Laible | 312/404 |
| 2010/0019641 | A1 | 1/2010 | Laible et al. | |
| 2010/0024463 | A1* | 2/2010 | Park | 62/340 |
| 2011/0210655 | A1* | 9/2011 | Brown et al. | 312/334.8 |
| 2011/0309732 | A1* | 12/2011 | Horil et al. | 312/404 |
| 2011/0316405 | A1* | 12/2011 | Fink et al. | 312/405.1 |
| 2012/0079845 | A1 | 4/2012 | Hong et al. | |
| 2012/0139402 | A1* | 6/2012 | Haidar et al. | 312/404 |
| 2013/0043780 | A1* | 2/2013 | Ootsuka et al. | 312/402 |
| 2014/0152166 | A1* | 6/2014 | Baum et al. | 312/404 |

FOREIGN PATENT DOCUMENTS

| | | | | |
|---|---|---|---|---|
| JP | 2008045846 A * | 2/2008 | | F25D 25/02 |
| WO | WO 2012014476 A1 * | 2/2012 | | F25D 25/00 |

* cited by examiner

DRAWER ASSEMBLY

TECHNICAL FIELD

The instant application relates generally to a drawer assembly for a refrigeration appliance and, more particularly, a drawer assembly that avoids slanting of the drawer during horizontal movement.

BACKGROUND

Drawer assemblies of a refrigeration appliance often utilize laterally located sliding mechanisms to allow horizontal movement for opening and closing of a drawer. When the sliding mechanisms move horizontally at different rates, the drawer can become slanted in a horizontal direction and may even become stuck in the cabinet.

SUMMARY

The following presents a simplified summary of the disclosure in order to provide a basic understanding of some example aspects described in the detailed description.

In one example aspect, a drawer assembly is provided for a refrigeration appliance comprising a cooled compartment. The cooled compartment is comprised of opposed, first and second interior walls. The drawer assembly comprises a unitary storage bin configured to move relative to the cooled compartment. The storage bin is defined by a front wall, a rear wall and opposed sidewalls that are arranged adjacent to the first and second interior walls of the cooled compartment. An uppermost portion of each of the opposed sidewalls comprises a projecting edge that extends outwards of the storage bin towards a respective one of the first and second interior walls of the cooled compartment. The rear wall comprises a reinforced edge that inhibits deflection of the rear wall along at least two axes. A pair of linear motion elements is installed between the first and second interior walls of the cooled compartment and the opposed sidewalls of the storage bin to enable movement of the storage bin in and out of the cooled compartment. A pair of support brackets couple the pair of linear motion elements to the opposed sidewalls of the storage bin. Each support bracket comprises a vertical face fixed to one respective linear motion element and a support face arranged at an angle relative to the vertical face that is fixed to one respective projecting edge of the storage bin.

In another example aspect, a drawer assembly is provided for a refrigeration appliance comprising a cooled compartment. The cooled compartment comprising opposed, first and second interior walls. The drawer assembly comprises a unitary storage bin configured to move relative to the cooled compartment. The storage bin is partially defined by opposed sidewalls that are arranged adjacent to the first and second interior walls of the cooled compartment. An uppermost portion of each of the opposed sidewalls comprises a projecting edge extending outwards of the storage bin towards a respective one of the first and second interior walls of the cooled compartment. The drawer assembly comprises a pair of linear motion elements installed between the first and second interior walls of the cooled compartment and the opposed sidewalls of the storage bin to enable movement of the storage bin in and out of the cooled compartment. The drawer assembly comprises a pair of support brackets coupling the pair of linear motion elements to the projecting edges of the sidewalls of the storage bin. The drawer assembly comprises a plurality of mounting blocks with at least one mounting block disposed between each support bracket and a respective sidewall of the storage bin. The projecting edges of the sidewalls comprise a first set of teeth and the plurality of mounting blocks comprise a second set of teeth configured to lockingly engage with the first set of teeth.

BRIEF DESCRIPTION OF THE DRAWINGS

These and other aspects are better understood when the following detailed description is read with reference to the accompanying drawings, in which.

DETAILED DESCRIPTION

Figure 1:
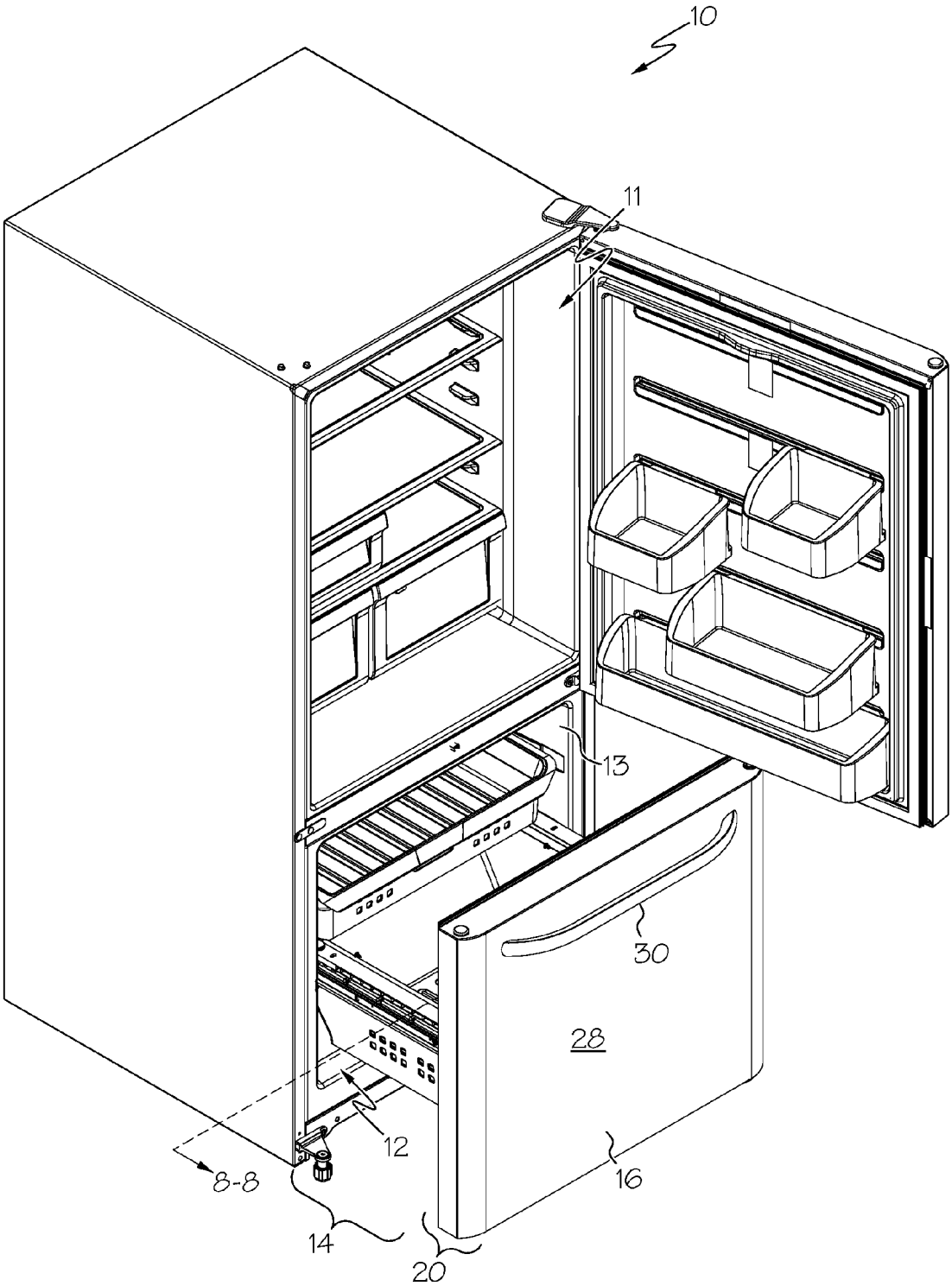
FIG. 1 is an example refrigeration appliance discussed herein.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, a refrigeration appliance 10 is shown that includes a fresh-food compartment 11 with a single door and a cooled compartment 12, although other embodiments can be refrigerators with an alternative arrangement of compartments. This may include side by side refrigerators, top-mount refrigerators, drawer-style refrigerators, or French door refrigerators. Alternatively, the refrigeration appliance 10 can also be any other cabinet-like structure that provides a cooled compartment 12 that may be characterized as a drawer, a chest or the like. The cooled compartment 12 comprises opposed, first and second interior walls 13 and may accommodate a drawer assembly 14 or a box-like configuration.

As shown in FIG. 1, the cooled compartment 12 of the refrigeration appliance 10 may be provided such that the drawer assembly 14 makes up substantially an entire compartment and is accessed directly from the exterior of the refrigeration appliance 10. Alternatively, the drawer assembly 14 may make up a part of a compartment and may be accessed indirectly after a door of such a compartment is first opened.

Figure 2:
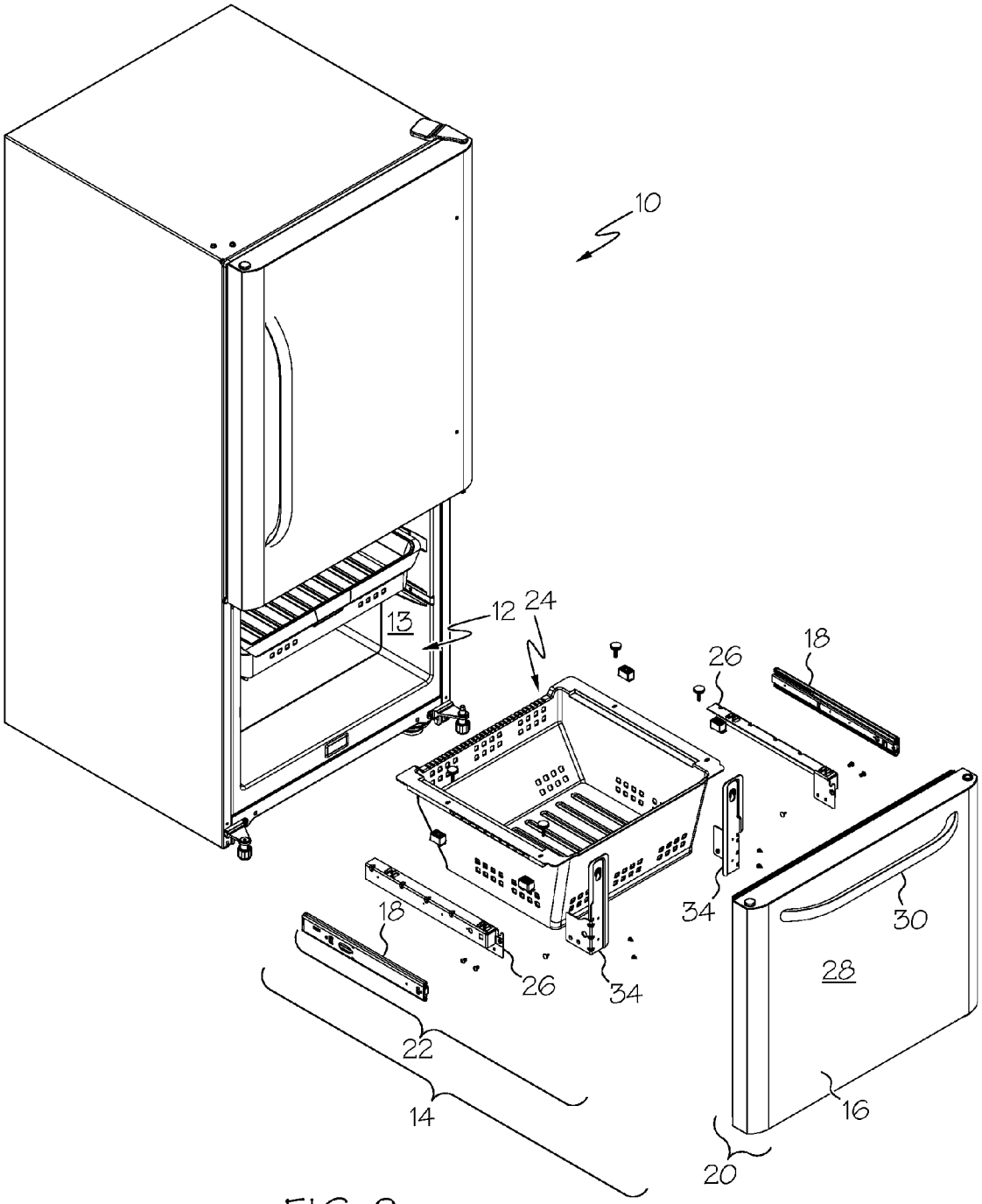
FIG. 2 is a partial exploded view of the refrigeration appliance.

FIG. 2 shows a partial exploded view of an example embodiment of the refrigeration appliance 10. The drawer assembly 14 includes a drawer 16 and a pair of linear motion elements 18. The drawer 16 may include a door portion 20 and a bin portion 22. The door portion 20 of the drawer 16 may include an external side 28 that is configured to conform to other parts of the refrigeration appliance 10 in shape. The door portion 20 may include a grasping structure, such as a handle 30, so that the drawer 16 can be manually pulled out of and pushed into the cooled compartment 12. The bin portion 22 may include a unitary storage bin 24, a pair of support brackets 26, and a pair of door braces 34. As shown in FIG. 2, the unitary storage bin 24 may be flanked by the pair of support brackets 26 on substantially opposite locations.

Figure 3:
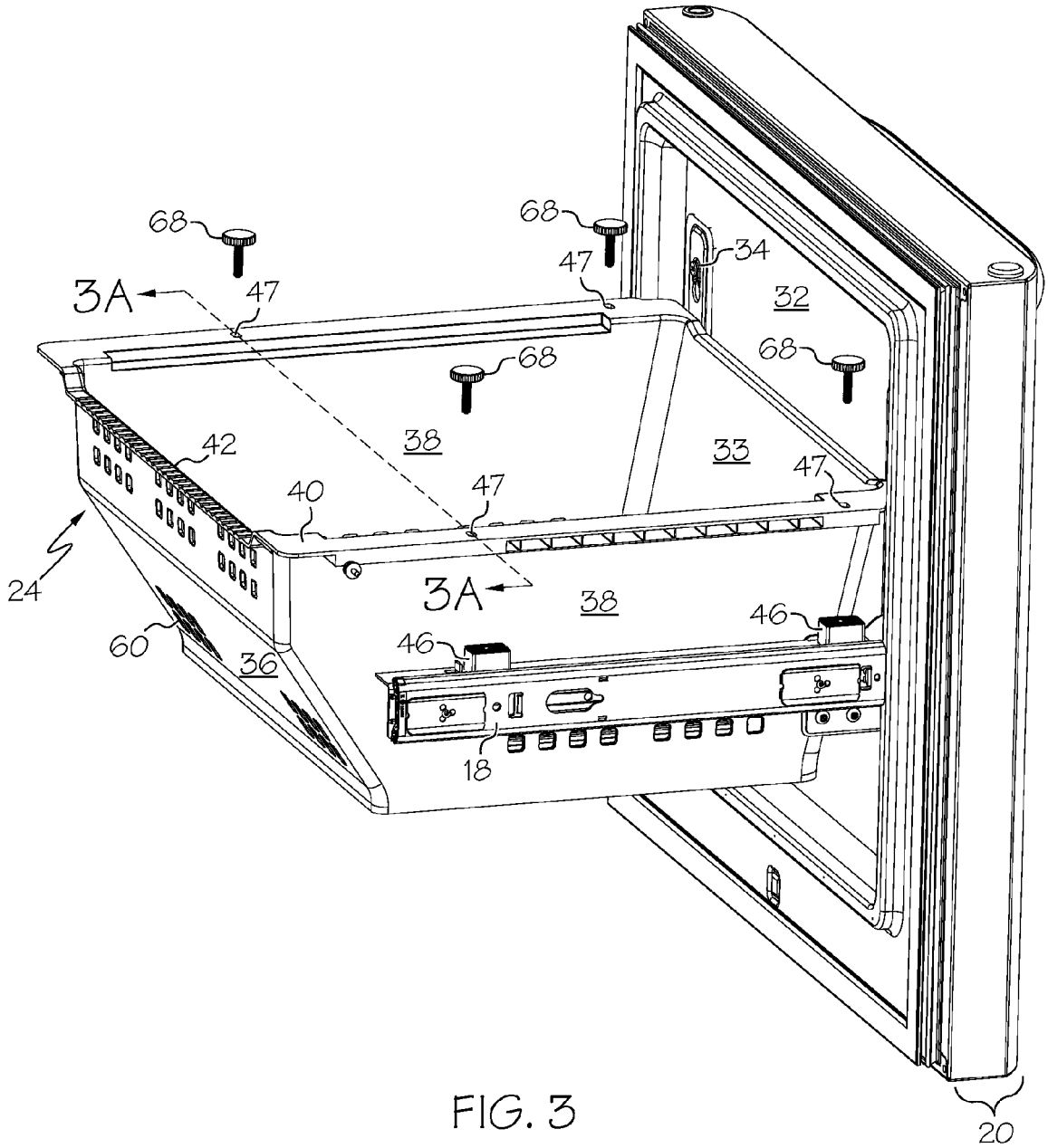
FIG. 3 is a perspective view of a storage bin of the example refrigeration appliance, in an isolated state.

Referring to FIG. 3, the unitary storage bin 24 is shown. The unitary storage bin 24 is defined by a front wall 33, a rear wall 36 and opposed sidewalls 38. The opposed sidewalls 38 of the unitary storage bin 24 are arranged adjacent to the first and second interior walls of the cooled compartment 12 (FIG. 1). The unitary storage bin 24 may be formed as a monolithic body, where the unitary storage bin 24 is made of a single piece of material. Alternatively, the unitary storage bin 24 may be constructed of multiple elements that are secured together as an unitary body. Preferably, the unitary storage bin 24 may be composed of a polymer material. Materials other than polymer may be used so long as the unitary storage bin 24 is of a rigid material. The preferred method of construction of the unitary storage bin 24 is injection molding; however, other construction methods known in the art may be used. As shown in FIG. 3, the unitary storage bin 24 may be made of a material with a sufficient thickness to prevent inward twisting and warping when food articles are placed for storage. The unitary storage bin 24 may be a uniform thickness or alternatively, portions of the unitary storage bin 24 may be different thicknesses. In a preferred embodiment, the unitary storage bin 24 may also include ventilation holes 60 that allow cold air to pass through the unitary storage bin 24. These ventilation holes 60 may be of varying sizes and shapes. Alternatively, the unitary storage bin 24 may include other ways to provide ventilation known in the art.

As mentioned earlier, the unitary storage bin 24 includes the rear wall 36. The rear wall 36 may comprise a reinforced edge 42 that inhibits deflection of the rear wall 36 along at least two axes to keep the unitary storage bin 24 from bending from food articles. Specifically, the reinforced edge 42 will assist in deflecting movement in the lateral and longitudinal axes as the drawer assembly 14 is pulled to the open and closed positions. The reinforced edge 42 reduces the ability of the rear wall 36 to bend and skew as the drawer assembly 14 is in motion. The reinforced edge 42 is preferably positioned at an uppermost portion of the rear wall 36 and extends outward from the unitary storage bin 24. The reinforced edge 42 may be of a variety of thicknesses and lengths to prevent bending, and the reinforced edge 42 may additionally include various strength-enhancing structures or geometries to further reduce bending and twisting, such as corrugation, bracing, etc. In addition to the reinforced edge 42, rear wall 36 may also have strength-enhancing structures and/or be corrugated. When the drawer assembly 14 is in the closed position, the rear wall 36 of the unitary storage bin 24 is adjacent to the rear wall 36 of the cooled compartment 12.

In addition to the rear wall 36, the unitary storage bin 24 may include projecting edges 40 that extend outwards of the unitary storage bin 24 towards the first and second interior walls of the cooled compartment 12 (FIG. 2). The projecting edges 40 may be present on the opposed sidewalls 38 and are preferably located at or near an uppermost portion of each of the opposed sidewalls 38. The projecting edges 40 are extensions off of the unitary storage bin 24. The projecting edges 40 may be of a width to resist twisting and warping of the unitary storage bin 24 from food articles. For instance, when the drawer assembly 14 is pulled in and out of the refrigeration appliance 10, the width of the projecting edges 40 resists inward movement in the lateral and longitudinal directions from food articles in the unitary storage bin 24. The projecting edge 40 may be thicker or thinner than the cross-section of the unitary storage bin 24.

In a preferred embodiment, the projecting edges 40 may run along the entire length of the opposed sidewalls 38. Alternatively, the projecting edges 40 may extend along only a portion of the opposed sidewalls 38. The projecting edges 40 may be a varied thickness along the unitary storage bin 24. For instance, the projecting edge 40 may be thicker near an end of the projecting edge 40 as shown in FIG. 3. Additionally, the shape of the projecting edge 40 may vary. As shown in FIG. 3, the projecting edges 40 are generally rectangular in shape, but the projecting edges 40 may be rounded or curved edges. At least a portion of the opposed sidewalls 38 may also be double-walled and/or may include reinforcing supports, such as a plurality of internal struts that extend between the double-walls, to provide additional strength-enhancing structures or geometries to further reduce bending and twisting of the unitary storage bin 24. The opposed sidewalls 38 or front wall 33 may also be corrugated to reduce bending and twisting.

The projecting edges 40 may further include projecting edge holes 47 or openings to allow for the unitary storage bin 24 to be secured to the drawer assembly 14. The projecting edge holes 47 are preferably through holes in the projecting edges 40. As shown in FIG. 3, four projecting edge holes 47 are shown, which include two projecting edge holes 47 on each projecting edge 40. The projecting edge holes 47 may vary in number, size and shape. The projecting edge holes 47 may also optionally include threading in its interior.

Figure 3A:
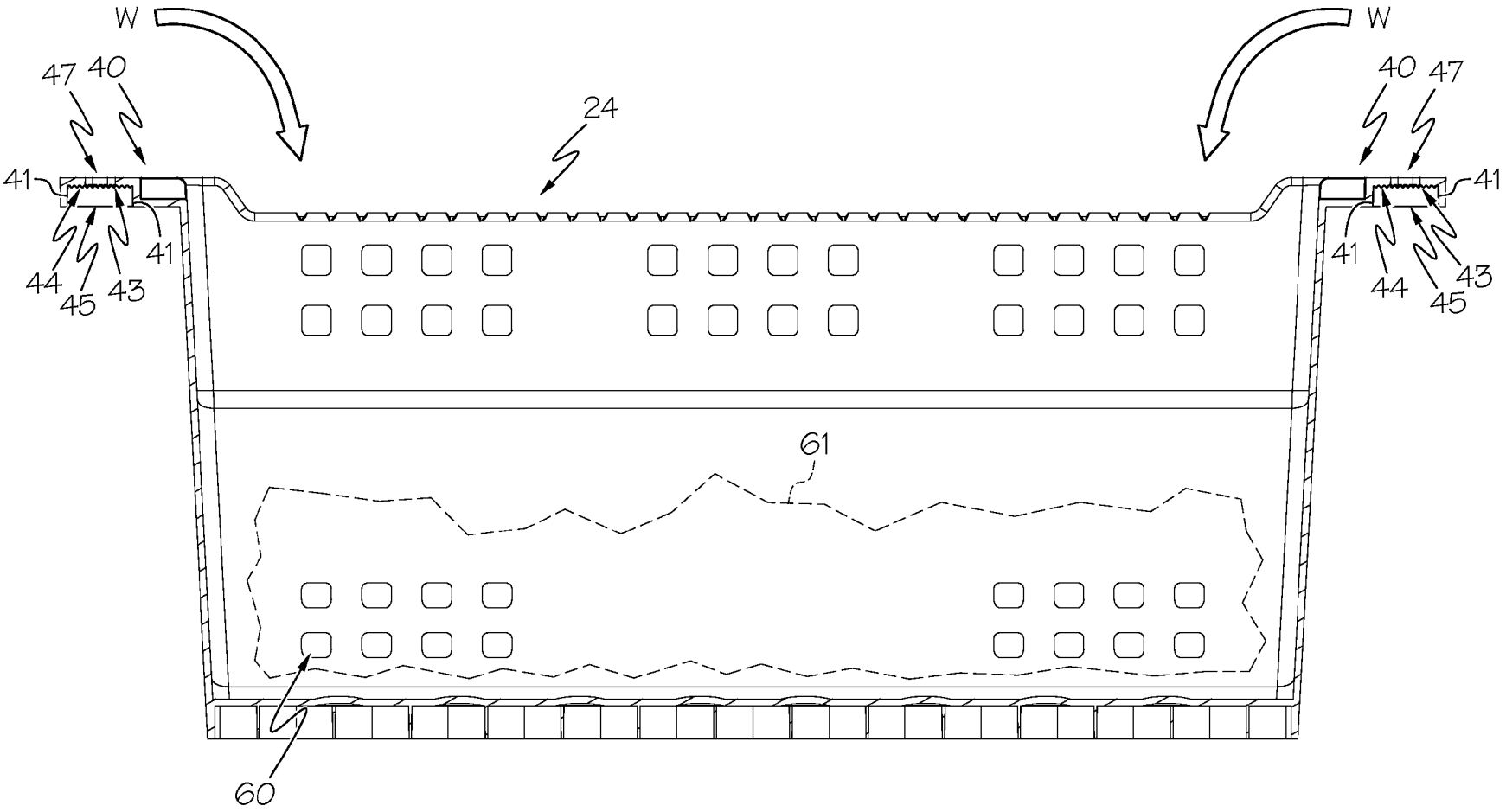
FIG. 3A is a cross-sectional view of the unitary storage bin taken along line 3A-3A of FIG. 3.

Turning now to FIG. 3A, an underside 45 of the projecting edge 40 may further comprise a first set of teeth 44, or grooves. The first set of teeth 44 can have various profiles, such as a linear profile as shown in FIG. 3A. The first set of teeth 44 may be formed underneath the projecting edges 40 during construction of the unitary storage bin 24. Alternatively, the first set of teeth 44 may be added to the underside 45 of the projecting edge 40 following construction of the unitary storage bin 24. The first set of teeth 44 may be composed of polymer or a similar rigid material.

As shown in FIG. 3A, the first set of teeth 44 or grooves may be pointed. Alternatively, the first set of teeth 44 may be rounded. In addition to differences in shape, the first set of teeth 44 may be a variety of thicknesses and depressions. Specifically, the depression of the first set of teeth 44 may be deep or shallow, or the thickness of the first set of teeth 44 may be varied. For example, the first set of teeth 44 may be relatively thicker, which would allow for less teeth or grooves to be present on the projecting edge 40, or if the first set of teeth 44 are relatively thinner, more teeth or grooves may be present on the projecting edge 40. Additionally, the first set of teeth 44 may be of varying lengths on the underside 45 of the projecting edge 40. For example, the first set of teeth 44 may be along the entire side length of the opposed sidewalls 38, or as shown in FIG. 3, the first set of teeth 44 may be present along only a portion of the opposed sidewalls 38.

The first set of teeth 44 may be arranged substantially parallel to the first and second interior walls of the cooled compartment 12, which is in the sliding direction of the drawer 16. This arrangement presents the first set of teeth 44 as perpendicular to a lateral axis of the unitary storage bin 24 to thereby inhibit or prevent the unitary storage bin 24 from collapsing inwards due to the weight of food articles stored in within the unitary storage bin 24. The first set of teeth 44 may also be arranged at various other angles relative to the opposed sidewalls 38, and the angle may be varied in other directions so long as the first set of teeth 44 may be engaged. By varying the angle, the inward skewing of the unitary storage bin 24 may be reduced. For example, inward skewing of the unitary storage bin 24 may be diminished by placing the first set of teeth 44 at a lower angle near an end of the projecting edge 40. Additionally, if the first set of teeth 44 is at a steep angle, the first set of teeth 44 may also provide a stronger engagement point.

Referring to FIG. 3A, the underside 45 of the projecting edge 40 may be arranged to provide an underneath cavity 43, or box-like structure. For example, protrusions 41 may create a perimeter surrounding the first set of teeth 44 to form the underneath cavity 43. The protrusions 41 may be the same length or of differing lengths, but preferably, the protrusions 41 are of uniform length. The protrusions 41 may be manufactured before, during, or after the construction of the projecting edges 40, and the protrusions 41 may be made of polymer or similar material. The underneath cavity 43 may provide a housing for the first set of teeth 44.

Figure 4:
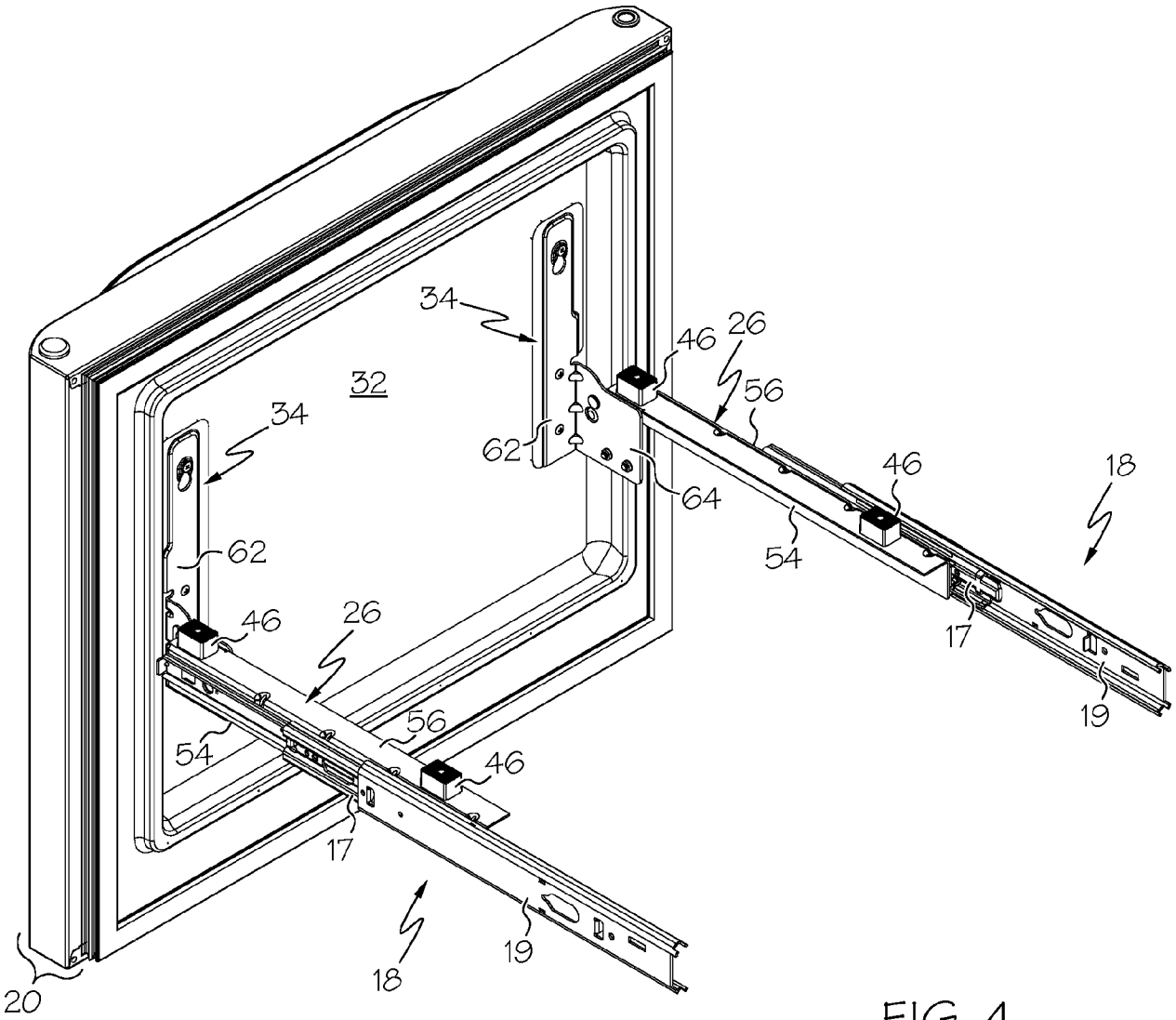
FIG. 4 is a perspective view of a pair of support brackets and a pair of linear motion elements in an extended condition.

Now referring to FIGS. 3-4, the drawer 16 may be configured to selectively close the cooled compartment 12 by the pair of linear motion elements 18. The linear motion element 18 may comprise any mechanism that allows for sliding. In one example, the linear motion elements 18 may be made of metal ball bearing slides or even a roller style slide or the like. As shown in FIG. 4, the linear motion elements 18 are shown in an extended position. The pair of linear motion elements 18 may be installed between the first and second interior walls of the cooled compartment 12 (FIG. 1) and corresponding support bracket 26 that connects to the opposed sidewalls 38 to enable movement of the unitary storage bin 24 (FIG. 3). The linear motion elements 18 are provided on the drawer 16 (FIG. 2), for example, one on each side. Each linear motion element 18 comprises an outer slide member 19 fixed to one interior wall of the cooled compartment 12 and an inner slide member 17. The inner slide member 17 is fixed to a respective support bracket 26 and slides with the outer slide member 19.

Figure 5:
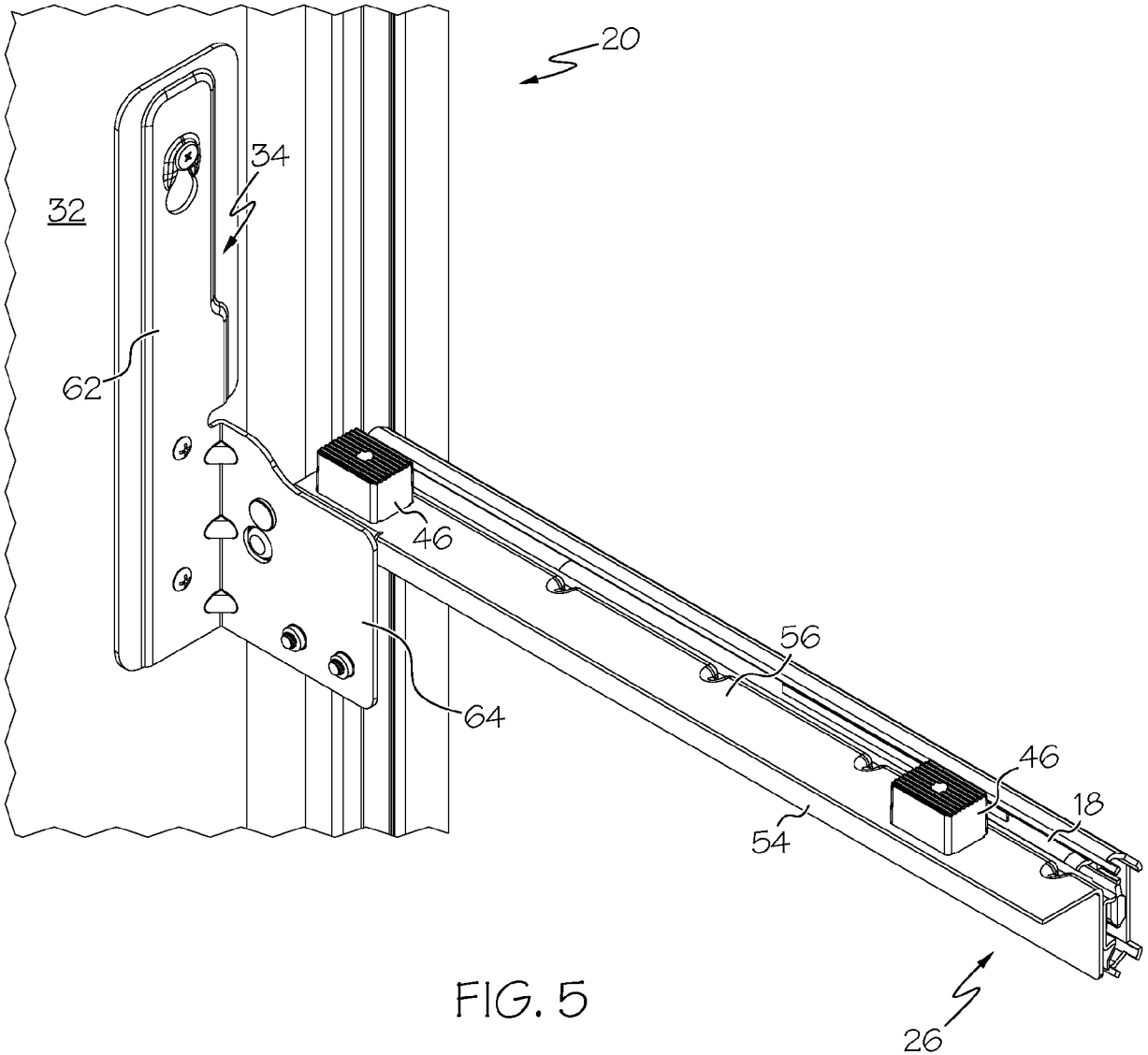
FIG. 5 is a perspective view of a support bracket, mounting blocks and a linear motion element in a retracted condition.

Turning now to FIGS. 4-5, the pair of door braces 34 may be used to attach the drawer assembly 14 (FIG. 2) to an internal side 32 of the door portion 20. FIG. 5 illustrates an isolated view of a door brace 34. Each door brace 34 may include a vertical support 62 and a horizontal support 64. The vertical support 62 and the horizontal support 64 may be a single part (as shown) or may be welded together or attached by any securing structure known in the art. The vertical support 62 may also be attached to the internal side 32 of the door portion 20 by any securing structure known in the art. The horizontal support 64 may include securing structures known in the art to attach to the corresponding support bracket 26 for movement of the drawer assembly 14. By attaching the horizontal support 64 to the corresponding support bracket 26, the drawer assembly 14 may be pulled in and out of the cooled compartment 12 by the handle 30. As described earlier, the support bracket 26 is fixed to the inner slide member 17 of the linear motion element 18. When the drawer assembly 14 is pulled out of the cooled compartment 12, the inner slide member 17 may slide out of the outer slide member 19, which is attached to the respective interior wall of the cooled compartment 12.

Figure 6:
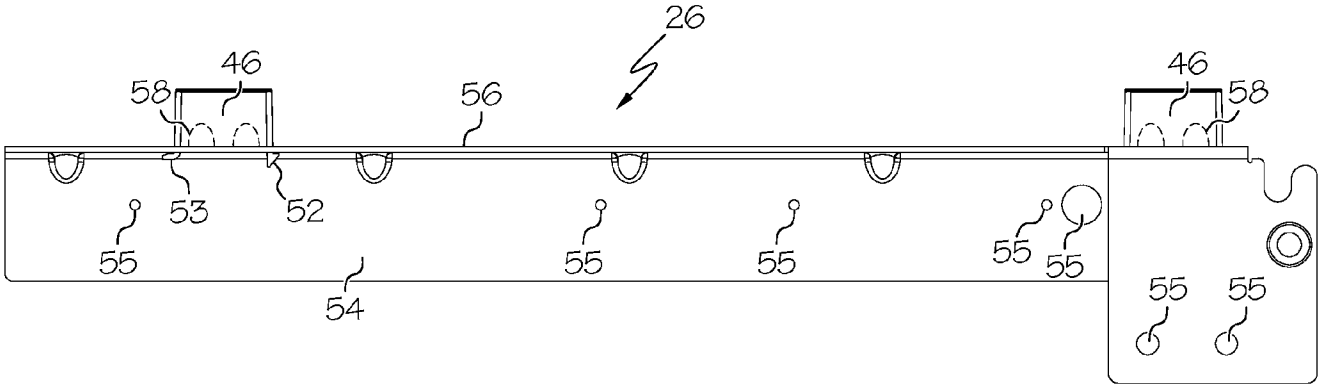
FIG. 6 is a side view of mounting blocks attached to a support bracket.

Referring to FIGS. 5-6, each support bracket 26 comprises a vertical face 54 and a support face 56. Preferably, the vertical face 54 and the support face 56 may be arranged perpendicular to one another at a 90 degree angle. Alternatively, the vertical face 54 and the support face 56 may be attached to one another at angles other than 90 degrees. In a preferred embodiment, the support bracket 26 may be comprised of angle iron or the like. As shown in FIG. 5, the vertical face 54 of the support bracket 26 is attached to the linear motion element 18, and the support bracket 26 may also fasten to one horizontal support 64 of the door brace 34. By attaching to the linear motion element 18 and door brace 34, the support bracket 26 provides a connection so that the unitary storage bin 24 may move in the linear direction in and out of the cooled compartment 12. The support bracket 26 and the horizontal support 64 of the door brace 34 may include corresponding holes, which may be used to permanently secure the support bracket 26 to the horizontal support 64 of the door brace 34 using tamper-resistant screws, bolts or similar securing structures. Alternatively, other securing structures known in the art may be used to attach the support bracket 26 to the door brace 34.

As shown in FIG. 6, an example support bracket 26 is shown with the vertical face 54 and the support face 56. To fasten the support bracket 26 to the linear motion element 18 and the door brace 34, the support bracket 26 may include support bracket holes 55 that correspond with respective holes on the linear motion element 18 and the door brace 34. These support bracket holes 55 are present along the vertical face 54 of the support bracket 26. On the support face 56 of the support bracket, a mounting block 46 is provided that is used to attach the unitary storage bin 24 to the support bracket 26 as well as inhibit lateral movement of the unitary storage bin 24. As shown in FIG. 6, the support face 56 of the support bracket 26 may additionally include upward projections 58 that may be used to engage the mounting block 46. Alternatively to the upward projections 58, the support bracket 26 may provide other methods in the art to engage or locate the mounting block 46. The support face 56 may optionally include openings that allow the mounting block 46 to become engaged. The support bracket holes 55 may be manufactured into the support face 56 to correspond with the respective mounting block 46. The openings may be of various sizes and shapes, and may be added to the support bracket 26 during or after manufacturing the support bracket 26. The openings in the support bracket 26 may be the same size as the mounting block 46 or may be smaller than the mounting block 46. However, one preferred embodiment includes the opening in the support bracket 26 that corresponds with the projecting edge holes 47 of the unitary storage bin 24 and the mounting block 46.

The mounting block 46 may be temporary or permanently engaged into the support bracket 26. The mounting block 46 may be placed into the support bracket 26 so that mounting block 46 resists movement. To remove the mounting block 46, force may be used to disengage the mounting block 46. As shown in FIG. 6, the preferred embodiment includes two mounting blocks 46 that are removably secured to the support bracket 26. The mounting blocks 46 are placed on opposing ends of the support bracket 26, but the mounting blocks 46 may be placed at any location on the support bracket 26. Moreover, the number and size of mounting blocks 46 may vary. Specifically, more than two mounting blocks 46 may be used, or one relatively larger mounting block 46 may be used along an extended length of the support bracket 26. The mounting block 46 as shown in FIG. 6 is rectangular in shape, although various geometries can be used.

Figure 7:
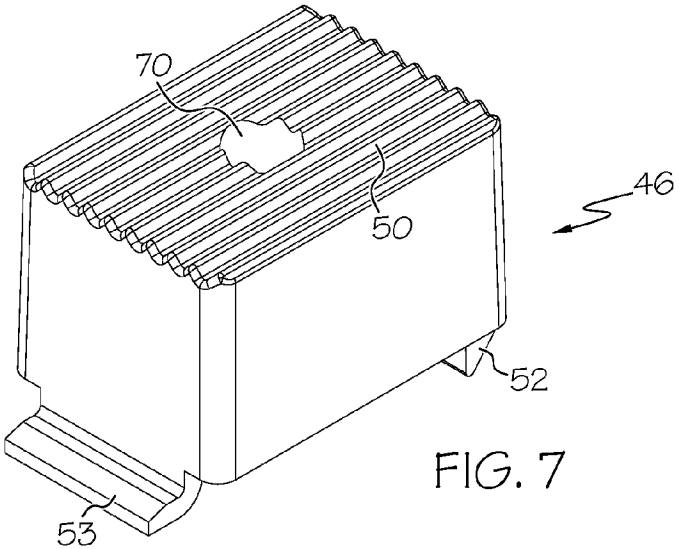
FIG. 7 is a perspective view of an example mounting block.

An example mounting block 46 is shown in FIG. 7, which illustrates the mounting block 46 having four sides along its perimeter. The mounting block 46 may include two sets of parallel sides, a through hole 70, a resilient latch arm 52 and second set of teeth 50. One set of parallel sides may be longer than the other set of parallel sides, but the sets of parallel sides may be of equal length depending upon the chosen geometry and are flat as shown in FIG. 7. To connect the two sets of parallel sides, the mounting block 46 may have rounded edges. Alternatively, the mounting block 46 may have pointed edges connecting the two sets of parallel sides. Size, width, and height of the mounting block 46 may vary based upon the configuration of the support bracket 26 and the unitary storage bin 24. Because the illustrated mounting block 46 is rectangular in shape, the mounting block 46 may fit in the underneath cavity 43 of the projecting edge 40. The protrusions 41 surrounding the first set of teeth 44 may provide a housing to insert the mounting block 46. The sizes of the mounting block 46 and the underneath cavity 43 should preferably correspond to each other.

The mounting block 46 may be formed as a unitary piece as shown in FIG. 7. The mounting block 46 may be manufactured from polymer material, but similar materials in the art may also be used. Alternatively, the mounting block 46 may be constructed of several pieces that may be combined to form the mounting block 46. Preferably, the mounting block 46 may be hollow construction; however, the mounting block 46 may alternatively be solid construction. The mounting block 46 may be manufactured from injection molding or a similar process. As shown in FIG. 7, the mounting block 46 may include an opening as the through hole 70. The through hole 70 may be flat or threaded in its interior (e.g. see FIG. 8) and may have a circumference that corresponds to openings on the support bracket 26 and the projecting edge 40 of the unitary storage bin 24. The through hole 70 may be formed during the manufacturing of the mounting block 46, or alternatively, the through hole 70 may be formed following manufacturing of the mounting block 46.

The mounting block 46 may additionally include at least one resilient latch arm 52, which may be formed with or added during or after the construction of the mounting block 46. The resilient latch arm 52 may be placed on a bottom of the mounting block 46 as shown in FIG. 7. Preferably, the resilient latch arm 52 is pointed and includes a catch to lock the resilient latch arm 52 into place, and may be flexible so as to allow the mounting block 46 to be removed from the support bracket 26. The resilient latch arm 52 may also be composed of the same polymer material as the mounting block 46. Alternatively, the resilient latch arm 52 may also be composed of materials other than polymer. In addition to the resilient latch arm 52, the mounting block 46 may include a fixed latch arm 53. The fixed latch arm 53 may be a lip that may be installed underneath the support bracket 26. As shown in FIG. 7, the resilient latch arm 52 and the fixed latch arm 53 are placed at opposing ends; however, the resilient latch arm 52 and the fixed latch arm 53 may be placed in other locations on the mounting block 46. The mounting block 46 may be installed in the support bracket 26 by first placing the fixed latch arm 53 into the opening of the support bracket 26; the lip of the fixed latch arm 53 may slip underneath the support bracket 26. Next, the mounting block 46 is pivoted downwards upon the fixed latch arm 53 until the resilient latch arm 52 securely engages the support bracket 26. Because the resilient latch arm 52 may be flexible and include a wedge or cam-shaped end, the resilient latch arm 52 may be bent and placed into the opening of the support bracket 26. The catch of the resilient latch arm 52 may be securely placed underneath the support bracket 26.

Figure 8:
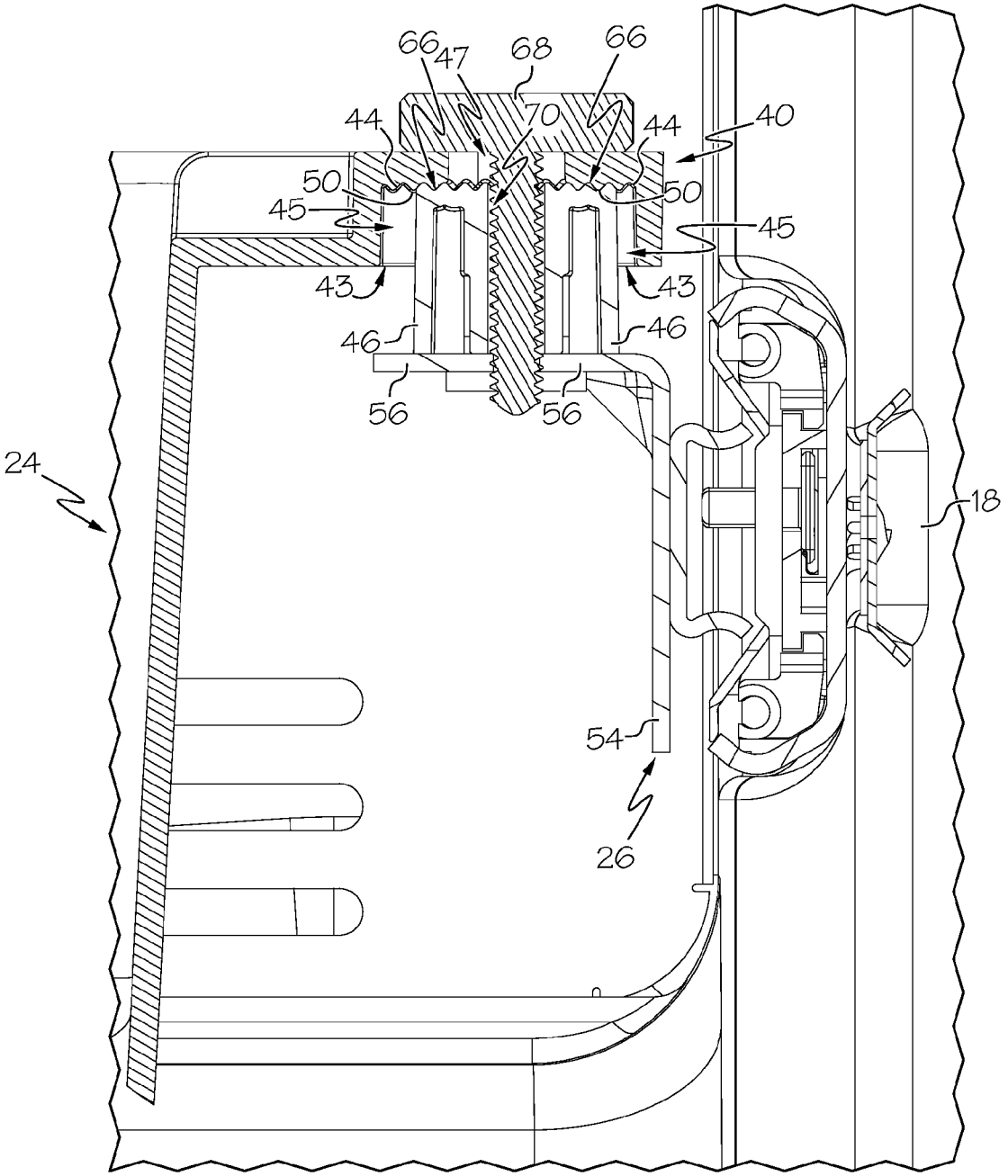
FIG. 8 is a cross-sectional view taken along line 8-8 of FIG. 1 of a projecting edge of the storage bin in an example engagement with a mounting block.

The mounting block 46 may additionally contain a second set of teeth 50 or grooves. The second set of teeth 50 may be present on a top side of the mounting block 46. The second set of teeth 50 may be added when the mounting block 46 is manufactured (e.g. molded in) or may be added after the manufacturing of the mounting block 46. Referring back to FIG. 3, when the mounting blocks 46 are placed in the support brackets 26, the unitary storage bin 24 and the corresponding projecting edge 40 may be placed over the support brackets 26. The underside 45 containing the first set of teeth 44 is configured to engage the second set of teeth 50 on the respective mounting block 46. Preferably, the second set of teeth 50 should include the same number of linear grooves as well as the same thickness of the first set of teeth 44. Still, various engagement schemes are contemplated. When the first set of teeth 44 and the second set of teeth 50 are arranged at the same angle, a locking engagement 66 is formed when the first set of teeth 44 of the projecting edge 40 and the second set of teeth 50 are pressed together. Referring to FIG. 8, the locking engagement 66 between the first set of teeth 44 and the second set of teeth 50 aligns the linear grooves in a direction that is perpendicular to the inward movement of the unitary storage bin 24, which will inhibit lateral movement when the unitary storage bin 24 is full with food articles 61 as shown in FIG. 3A. Arrows W illustrate the inward force that walls of the unitary storage bin 24 may experience from the weight loading of the food articles 61. By inhibiting or preventing relative movement of the first and second sets of teeth 44, 50, inward movement of the front wall, the rear wall and/or opposed sidewalls of the unitary storage bin 24 may therefore be counteracted.

Referring back to FIG. 8, the first set of teeth 44 and the second set of teeth 50 are shown to be in the locking engagement 66. After the locking engagement 66 is achieved, a fastener 68, such as a thumb screw, may pass through the projecting edge 40, the mounting block 46, and support bracket 26. The fastener 68 may extend through the corresponding fabricated holes of the projecting edge hole 47, through hole 70 of the mounting block 46, and support bracket 26. If the mounting block 46 or the projecting edge 40 includes interior threading, the fastener 68 may be screwed into the respective interior threading. Preferably, the fastener 68 may be attached and removed without the use of tools. For instance, the thumb screw is preferred because a user may easily turn the thumb screw using only their fingers. However, the fastener 68 may be attached with the use of tools, such as a screw driver and the like. By providing a fastener 68 that does not require removal with tools, a user may easily remove the unitary storage bin 24 from the drawer assembly 14, which may allow the user to quickly remove the fasteners 68 to either clean the unitary storage bin 24 or remove food articles. In addition to the locking engagement 66, the fastener 68 applies a clamping force to further engage the first set of teeth 44 to the second set of teeth 50. This clamping force also will inhibit movement between the first set of teeth 44 and the second set of teeth 50 and reduce movement in the lateral direction.

Turning back to FIG. 3, one preferred embodiment is shown. The support brackets 26 are attached to both the door portion 20 and the pair of linear motion elements 18. The support brackets 26 are attached to the door portion 20 by the pair of door braces 34. Each support bracket 26 includes two mounting blocks 46, which results in a total of four mounting blocks 46 for the preferred embodiment. The unitary storage bin 24 is flanked by two support brackets 26 along the opposed sidewalls 38. The projecting edges 40 of the unitary storage bin 24 lay over the two support brackets 26. Each projecting edge 40 includes the respective underside 45, where the underside 45 contains the first set of teeth 44. When the projecting edge 40 is placed over the support bracket 26, each underside 45 will fit over the respective mounting block 46. The first set of teeth 44 of the projecting edge 40 and the second set of teeth 50 of the respective mounting block 46 are placed to form the locking engagement 66, which is fastened using the fastener 68.

Referring back to FIG. 1, when the user pulls the handle 30 of the refrigeration appliance 10, the drawer assembly 14 will be moved in the horizontal direction as a single unit. Thus, the unitary storage bin 24 is moved outwards from the cooled compartment 12 and is accessible to the user. As mentioned earlier, the unitary storage bin 24 is attached to the door portion by support brackets 26 and door braces 34, and the unitary storage bin 24 is connected to the cooled compartment 12 using linear motion elements 18. As the drawer assembly 14 is moved in the horizontal direction, the four locking engagements 66 provide for a stable and anti-skew connection from the door portion 20 to the unitary storage bin 24. The locking engagements 66 also prevent the drawer assembly 14 from becoming slanted or stuck when the user grabs the handle 30 to open or close the cooled compartment 12.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A drawer assembly in a refrigeration appliance comprising:

a cooled compartment comprising opposed, first and second interior walls;

a unitary storage bin configured to move relative to the cooled compartment, the storage bin defined by a front wall, a rear wall and opposed sidewalls that are arranged adjacent to the first and second interior walls of the cooled compartment, wherein an uppermost portion of each of the opposed sidewalls comprise a projecting edge extending outwards of the storage bin towards and along a respective one of the first and second interior walls of the cooled compartment, and wherein the rear wall comprises a reinforced edge that inhibits deflection of the rear wall along at least two axes;

a pair of linear motion elements installed between the first and second interior walls of the cooled compartment and the opposed sidewalls of the storage bin to enable movement of the storage bin in and out of the cooled compartment;

a pair of support brackets coupling the pair of linear motion elements to the opposed sidewalls of the storage bin, each support bracket comprising a vertical face fixed to one respective linear motion element and a support face arranged at an angle relative to the vertical face that is fixed to one respective projecting edge of the storage bin; and a plurality of mounting blocks with at least one mounting block disposed between each support bracket and a respective sidewall of the storage bin, each mounting block removably attached to one of the support brackets; and a plurality of removable fasteners that removably secure the unitary storage bin to the mounting blocks, wherein an underside of each projecting edge of the sidewalls comprises a first set of alternating teeth and grooves and each mounting block comprises a second set of alternating teeth and grooves configured to lockingly engage with the first set of alternating teeth and grooves of a corresponding projecting edge to inhibit lateral movement of the storage bin, wherein the first set of alternating teeth and grooves comprises a first set of linear teeth and a first set of linear grooves that are linearly aligned along a first direction that is parallel to a sliding direction of the storage bin in and out of the cooled compartment and alternate along a second direction transverse to the first direction, and wherein the second set of alternating teeth and grooves comprises a second set of linear teeth and a second set of linear grooves that are linearly aligned along the first direction and alternate along the second direction, so that the first and second sets of teeth are thereby arranged perpendicular to a lateral axis of the unitary storage bin to thereby inhibit the unitary storage bin from collapsing inwards due to the weight of articles stored within the unitary storage bin, and wherein each removable fastener passes through an opening in an uppermost side of each projecting edge of the sidewalls to lockingly engage a respective one of the plurality of mounting blocks and thereby apply a clamping force between the first and second sets of teeth.

2. The drawer assembly of claim 1, further comprising a drawer configured to selectively close the cooled compartment and being mounted to said pair of support brackets to operate the linear motion elements so that the storage bin and drawer can be moved as a unit.

3. The drawer assembly of claim 1, wherein each linear motion element comprises an outer slide member fixed to one interior wall of the cooled compartment, and an inner slide member slidable with respect to the outer slide member and fixed to one support bracket.

4. The drawer assembly of claim 1, wherein the vertical face and the support face of each support bracket are perpendicular.

5. The drawer assembly of claim 1, wherein each support bracket comprises angle iron.

6. The drawer assembly of claim 1, wherein the plurality of fasteners are operable without the use of tools.

7. The drawer assembly of claim 6, wherein each mounting block comprises an opening permitting one of the fasteners to threadingly extend therethrough.

8. The drawer assembly of claim 1, wherein all of the front wall, rear wall and opposed sidewalls of the storage bin are formed as a monolithic body.

9. The drawer assembly of claim 1, wherein the reinforced edge of the rear wall is positioned at an uppermost portion of the rear wall and extends outwards of the storage bin.

10. The drawer assembly of claim 1, wherein each removable fastener passes through the first and second sets of teeth.

11. The drawer assembly of claim 1, wherein each removable fastener passes through a hole in a corresponding mounting block.

12. The drawer assembly of claim 1, wherein each removable fastener is a threaded fastener that threadably engages a corresponding mounting block.

13. A drawer assembly in a refrigeration appliance comprising:

a cooled compartment comprising opposed, first and second interior walls;

a unitary storage bin configured to move relative to the cooled compartment, the storage bin partially defined by opposed sidewalls that are arranged adjacent to the first and second interior walls of the cooled compartment, and an uppermost portion of each of the opposed sidewalls comprises a projecting edge extending outwards of the storage bin towards and along a respective one of the first and second interior walls of the cooled compartment;

a pair of linear motion elements installed between the first and second interior walls of the cooled compartment and the opposed sidewalls of the storage bin to enable movement of the storage bin in and out of the cooled compartment;

a pair of support brackets coupling the pair of linear motion elements to the projecting edges of the sidewalls of the storage bin; and a plurality of mounting blocks with at least one mounting block disposed between each support bracket and a respective sidewall of the storage bin; each mounting block removably attached to one of the support brackets; and a plurality of removable fasteners that removably and lockingly secure the unitary storage bin to the mounting blocks via a clamping force, each removable fastener comprising a main body having a thickness;

wherein an underside of each projecting edge of the sidewalls comprises a first set of alternating teeth and grooves and each mounting block comprises a second set of alternating teeth and grooves configured to lockingly engage with the first set of alternating teeth and grooves of a corresponding projecting edge to inhibit lateral movement of the storage bin, wherein the first set of alternating teeth and grooves define a first width and are linearly aligned along a first direction, and wherein the second set of alternating teeth and grooves define a second width and are linearly aligned along the first direction, so that locking engagement of the first and second sets of teeth via said clamping force thereby inhibits the unitary storage bin from collapsing inwards due to the weight of articles stored within the unitary storage bin, and wherein the main body of each removable fastener passes through a respective opening in an uppermost side of each projecting edge of the sidewalls to lockingly engage a respective one of the plurality of mounting blocks, wherein the opening is larger than the thickness of the main body and the first width of the first set of teeth is larger than the second width of the second set of teeth.

14. The drawer assembly of claim 13, wherein the first and second sets of alternating teeth and grooves are arranged substantially parallel to the first and second interior walls of the cooled compartment.

15. The drawer assembly of claim 13, wherein the first and second sets of alternating teeth and grooves are arranged at an angle relative to the sidewalls of the storage bin.

16. The drawer assembly of claim 13, further comprising at least two mounting blocks coupled to each support bracket such that each sidewall of the storage bin is supported in at least two locations.

17. The drawer assembly of claim 13, wherein each mounting block comprises a resilient latch arm that removably secures said mounting block to a respective support bracket.

18. The drawer assembly of claim 17, wherein each support bracket further comprises an upward projection that is received within a corresponding mounting block to support and locate said mounting block upon said support bracket.

19. The drawer assembly of claim 13, wherein the plurality of fasteners are operable without the use of tools.

20. The drawer assembly of claim 13, wherein each support bracket comprises a vertical face fixed to one respective linear motion element and a support face arranged at an angle relative to the vertical face that is fixed to one respective projecting edge of the storage bin.

* * * * *